US005128233A

United States Patent [19]

Beisswenger et al.

[11] Patent Number: 5,128,233

[45] Date of Patent: Jul. 7, 1992

[54] ELEMENT HAVING IMPROVED ADHESION OF AUXILIARY LAYERS TO FILM SUPPORTS CONTAINING ANTISTATIC LAYERS

[75] Inventors: Rudolf W. Beisswenger, Neu-Isenburg, Fed. Rep. of Germany; Kurt B. Gundlach, Webster, N.Y.

[73] Assignee: E. I. Du Pont de Nemours and Company, Wilmington, Del.

[21] Appl. No.: 817,627

[22] Filed: Jan. 7, 1992

Related U.S. Application Data

[63] Continuation of Ser. No. 586,114, Sep. 21, 1990, abandoned, which is a continuation-in-part of Ser. No. 471,145, Jan. 26, 1990, abandoned.

[51] Int. Cl.[5] ..... G03C 1/76

[52] U.S. Cl. ..... 430/271; 430/523; 430/527; 430/528; 430/529; 430/531; 430/533; 428/414; 428/522; 428/913

[58] Field of Search ..... 430/271, 523, 527, 528, 430/529, 531, 533, 534, 539; 428/414, 522, 447, 913

[56] References Cited

U.S. PATENT DOCUMENTS

| | | | |
|---|---|---|---|
| 4,571,379 | 2/1986 | Yamazaki et al. | 430/534 |
| 4,585,730 | 4/1986 | Cho | 430/527 |
| 4,859,570 | 8/1989 | Miller | 430/271 |
| 4,863,801 | 9/1989 | Vallarino | 428/414 |
| 4,891,308 | 1/1990 | Cho | 430/527 |
| 4,940,655 | 7/1990 | Gundlach | 430/523 |

*Primary Examiner*—Jack P. Brammer

[57] ABSTRACT

A film support having an auxiliary layer coated over an antistatic layer coated on one side thereof is described. This element, which is particularly useful for the application of subsequently applied photosensitive layers on side opposite said auxiliary layer, comprises gelatin, a crosslinking agent, optionally a conductive polymer and an adhesion promoting amount of an adhesion agent, said adhesion agent selected from the group consisting of: compounds containing at least one —$NH_2$ group and compounds containing at least two —NH groups, wherein said adhesion agent is sufficiently soluble in water that said adhesion promoting amount of adhesion agent may be dissolved in the dispersion used to coat said auxiliary layer, with the proviso that said adhesion agent is not malonamide. Preferred adhesion agents are urea, thiourea and 2-imidazolidone. Improved adhesion of the auxiliary layer to the antistatic layer is achieved.

21 Claims, No Drawings

ELEMENT HAVING IMPROVED ADHESION OF AUXILIARY LAYERS TO FILM SUPPORTS CONTAINING ANTISTATIC LAYERS

This is a continuation of application Ser. No. 07/586,114 filed Sep. 21, 1990, now abandoned which was a continuation-in-part of Ser. No. 07/471,145, filed Jan. 26, 1990, now abandoned.

FIELD OF THE INVENTION

This invention relates to photosensitive elements containing a permanent antistatic layer. More particularly, this invention relates to photosensitive elements containing auxiliary layers which exhibit improved adhesion to permanent antistatic layers.

BACKGROUND OF THE INVENTION

Polymeric films develop and accumulate static charges. Static charge is a particular problem when the film is a support for a machine processable photosensitive element. Static charges caused when the film slides in and out of these machines can be discharged causing unwanted exposure of the photosensitive layer.

To prevent static build-up, it is conventional to apply an antistatic layer, that is, a layer which prevents the build-up of static charge, to one or both sides of the support. When applied to the support of a photosensitive element, the antistatic layer reduces the propensity of the film to build-up static charge. Thus, the photosensitive element can be wound, unwound, processed, and otherwise used successfully without problems caused by static build-up.

It is also conventional to apply auxiliary layers to these supports for a myriad of reasons. For example, it may be necessary to have an antiblocking layer to prevent the support from sticking while wound up or while stacked in layers. It may be necessary to have a gelatin-containing backing layer for a photosensitive element. This backing layer may be useful as an anticurl or antihalation layer, for example.

When auxiliary layers are used over antistatic layers, they must conduct the antistatic qualities from that layer to the surface. It is also necessary that these auxiliary layers have excellent adhesion to the antistatic layer. This is especially necessary when the antistatic layer is applied at a high coating weights, e.g., 4 $mg/dm^2$ to about 15 $mg/dm^2$, for example. Good adherence means that there is essentially no separation between the auxiliary layer and the antistatic layer during normal handling and processing of the photosensitive element.

Antistatic layers are well known in the art. For example, Schadt, U.S. Pat. No. 4,225,665 and Miller, U.S. Pat. Nos. 4,701,403 and 4,859,570, disclose particularly effective antistatic layers for photosensitive elements. Schadt, U.S. Pat. No. 4,225,665 describes the art in this area.

Cho, U.S. Pat. No. 4,585,730, describes an auxiliary layer containing a conductive polymer. This layer is coated above the antistatic layer and maintains the antistatic properties of the element. Additionally, in Gundlach, U.S. Pat. No. 4,940,555, another auxiliary layer with excellent qualities is described. This layer, which comprises gelatin and an aqueous dispersion of a polymerized vinyl compound, is applied over the antistatic layer after the pH is adjusted to 5 to 7. However, in both the photosensitive element disclosed by Cho and that disclosed by Gundlach there are occasional problems caused by poor adhesion between the antistatic layer and the auxiliary layer.

Cho, U.S. Pat. No. 4,891,308, provides only a partial solution. There are still minor problems with anchorage, especially if the antistatic layer is applied as a thick layer. In addition, this coating is not suitable for all photosensitive elements.

There is a long-standing need to provide a simple, easily applied layer which can be coated over an antistatic layer with excellent adhesion and good conduction of static protection thereto.

SUMMARY OF THE INVENTION

In accordance with this invention there is provided a photographic element comprising:

(A) a polymeric film support having carboxyl groups attached to the surface thereof;

(B) a photosensitive layer coated on one side of the support;

(C) a permanent antistatic layer coated directly on the surface of the support opposite the photosensitive layer, said antistatic layer consisting essentially of the reaction product of:

(1) a water-soluble, electrically conductive polymer having functionally attached carboxyl groups integral to the polymer, and (2) a polyfunctional substituted aziridine wherein at least one hydrogen atom on a carbon atom of the aziridine ring is substituted with an alkyl substituent wherein alkyl is of 1 to 6 carbon atoms, wherein the aziridine interlinks the water-soluble, electrically conductive polymer having functionally attached carboxyl groups integral to the polymer and the carboxyl groups on the surface of the support to form an antistatic layer; and (D) an auxiliary layer coated over said antistatic layer, said auxiliary layer consisting essentially of an aqueous dispersion of gelatin, a gelatin cross-linking agent, and an adhesion promoting amount of an adhesion agent selected from the group consisting of a compound containing at least one —$NH_2$ group, a compound containing at least two —NH groups, and mixtures thereof wherein said adhesion agent is sufficiently soluble in water that said adhesion promoting amount of adhesion agent may be dissolved in the dispersion used to coat said auxiliary layer, with the proviso that said adhesion agent is not malonamide.

Preferred classes of adhesion agents are amides containing at least one —$NH_2$ group, amides containing at least two —NH groups, urea, substituted ureas containing at least one —$NH_2$ group, substituted ureas containing at least two —NH groups, guanidine hydrochloride, and thiourea. The preferred adhesion agents are urea, thiourea and 2-imidazolidone (ethyleneurea).

In a particularly preferred embodiment, this invention is a photographic film element comprising dimensionally stable polyethylene terephthalate film suitably subbed on both sides with a thin, anchoring substratum of a conventional resin sub over which is applied a gelatin sublayer on one side only. On the resin/gelatin subbed side of this support, a standard, gelatino, silver halide emulsion layer is applied and this layer overcoated with a conventional gelatin abrasion layer. On the side opposite to the side containing the emulsion layer, a permanent antistatic layer disclosed in Miller, U.S. Pat. No. 4,859,570, is applied, directly over the resin sub, preferably at a coating weight of about 4 mg/dm$^2$ to about 15 mg/dm$^2$. The novel auxiliary layer herein described is coated on top of the antistatic layer at a coating weight of about 20 mg/dm$^2$ to about 100 mg/dm$^2$.

DETAILED DESCRIPTION OF THE INVENTION

The invention is a versatile photosensitive element comprising: a support, a photosensitive layer, at least one permanent antistatic layer present on the support, and an auxiliary layer on the antistatic layer.

Auxiliary Layer

The novel auxiliary layer of this invention consists essentially of an aqueous gelatin dispersion of at least one crosslinking agent, optionally, but preferably, at least one dispersing agent, and an adhesion promoting amount of adhesion agent more fully described below. It is coated over the antistatic layer at a coating weight of about 20 mg/dm$^2$ to about 100 mg/dm$^2$, preferably about 35 mg/dm$^2$ to about 65 mg/dm$^2$, expressed as the weight of gel coated, using conventional coating techniques. The auxiliary layer is preferably coated at a pH in the range of about 4.5 to 6, more preferably about 4.8 to about 5.4.

The adhesion agent is a compound possessing in its structure at least one —$NH_2$ group, at least two —NH groups, or mixtures thereof and which is sufficiently soluble in water that said adhesion promoting amount of adhesion agent may be dissolved in the dispersion used to coat said auxiliary layer. The adhesion agent should be sufficiently high boiling or be sufficiently soluble in water that it is not lost from the auxiliary layer during the coating operations. Compounds with a boiling point greater than 65° C. may be used to advantage. The adhesion agent should not have an adverse effect on the photographic properties of the photosensitive layer.

Compounds which have been shown to be effective in promoting adhesion include: primary amines, such as iso-butyl amine, ethylenediamine, diethylenetriamine, triethylenetetraamine, etc.; secondary amines which contain two secondary amine groups, such as piperazine etc.; amides containing at least one —$NH_2$ group, such as acetamide, etc.; amides containing at least two —NH groups, such as 2,5-piperazinedione (glycine anhydride), etc.; urea; thiourea; substituted ureas containing at least one —$NH_2$ group, such as methylurea, N,N-dimethylurea, ethylenebisurea, hydroxymethylurea, biuret, etc.; substituted ureas containing least two —NH groups, such as 1,3-dimethylurea, 1,3-diethylurea, dihydroxymethylurea, 2-imidazolidone (ethyleneurea), etc.; and guanidine hydrochloride. Compounds which did not contain at least one —$NH_2$ group or two —NH groups, such as triethyl amine, 4-diazobicyclo[2.2.2]octane (DABCO), N,N,N',N'-tetramethylurea, N-methylacetamide, N,N-dimethylacetamide and piperidine did not improve adhesion. Malonamide also did not improve adhesion.

The preferred classes of adhesion agents are primary amides, compounds containing at least two secondary amide groups, urea, substituted ureas containing at least one —$NH_2$ group or at least two —NH groups, and guanidine hydrochloride. Preferred adhesion agents are urea, thiourea and 2-imidazolidone.

"Adhesion promoting amount of adhesion agent" means sufficient adhesion agent to enhance the adhesion without causing any deleterious side effects. While this amount may vary depending on the adhesion agent chosen, the adhesion agent is normally present in the auxiliary layer in the broad range of 10–150 mmol per 200 gm of gelatin present, and more preferably in the range of 30–110 mmol per 200 gm of gelatin.

"Gelatin dispersion" denotes a binder wherein the major component is gelatin. Gelatin substitutes, e.g., polyvinyl alcohol, dextran, cellulose derivatives, modified gelatins, a water-soluble latex, etc., may be present in minor amounts, e.g., less than 17% by weight.

Addition of the adhesion promoting amount of adhesion agent to form the novel auxiliary layer represents a simple and easy manner in which both antistatic properties and improved adhesion can be achieved. When this layer is made and applied as taught herein, many advantages are obtained. First, this layer will provide excellent antistatic properties on the surface of the film. Next, this layer is stable and will survive the rigors of processing the photosensitive layer without any visible delamination of any of the aforementioned layers, one from the other. Additionally, this element will have good visible properties.

A mixture of the gelatin binder in water, the gelatin crosslinking agent, the adhesion promoting amount of adhesion agent, and preferably the dispersing agent, are made up prior to coating. An optional conductive polymer may also be added. Other conventional additives, e.g., antihalation dyes, etc. may also be present.

Adhesion agent may be added to the aqueous dispersion used to make the auxiliary layer of this invention at any time. A convenient way to add the adhesion agent is to add 20% by weight aqueous adhesion agent to the aqueous dispersion just prior to coating the auxiliary layer.

Gelatin crosslinking agents common in the field of photographic elements used in the auxiliary layer of this invention include: formaldehyde, chrome alum, etc. Formaldehyde is a particularly preferred agent and is present in the range of 0.5% to 3.0% by weight, and preferable, in a range of 0.75% to 2.5% by weight of the gelatin binder.

Preferably at least one dispersing agent or coating aid, such as an anionic surfactant, is added to improve the ability of the dispersion to be applied on the antistatic layer. Low levels, e.g., 10 to 100 gm per 200 gm of gelatin present, of a 14.9% aqueous solution of sodium lauryl ether sulfate, e.g. Polystep® B-27, Stephan Chem. Co., Northfield, Ill., can be used, for example. Mixtures of two or more coating aids may also be present. Most conventional coating aids are suitable within the metes and bounds of this invention.

Optionally, a conductive polymer or polymers may be added to the auxiliary layer. A useful conductive polymer is the 3:1 copolymer of the sodium salt of styrene sulfonic acid and maleic acid. If present, these polymers may be added to the auxiliary layer in a range of 1 to 10% by weight of the gelatin dispersion/binder, preferably at 4 to 6% by weight.

Antistatic Layer

An antistatic layer taught in Miller, U.S. Pat. No. 4,859,570, incorporated herein by reference, is applied over the resin sub layers. The preferred coating weight is 4 mg/dm$^2$ to 15 mg/dm$^2$; the more preferred coating weight is 8 mg/dm$^2$ to 10 mg/dm$^2$. The element is then heat relaxed and the auxiliary layer of this invention coated on top of antistatic layer.

In brief, an aqueous solution of a water-soluble, electrically conductive polymer and a polyfunctional substituted aziridine is prepared, and a small amount of a suitable wetting agent or coating agent added thereto. The aqueous solution is coated onto the support having carboxyl groups attached to the surface. The aziridine interlinks the water-soluble, electrically conductive polymer and the carboxyl groups of the support to form a permanent antistatic layer. Although ranges of from 100:4 to 100:30 (weight to weight) may be used to advantage, a conductive polymer/aziridine ratio of 100:10 is preferred.

A preferred electrically conductive polymer is the 3:1 copolymer of the sodium salt of styrene sulfonic acid and maleic acid (disodium salt). In the polyfunctional aziridine at least one hydrogen atom on a carbon atom of the aziridine ring is substituted with an alkyl substituent of 1 to 6 carbon atoms. Preferred polyfunctional aziridines are pentaerythritol-tri-[beta-(N-alkyl or dialkyl-substituted aziridinyl) propionate]s, represented by the formula:

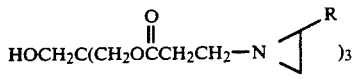

where R is alkyl or dialkyl of 1 to 6 carbon atoms, preferably 1 to 4 carbon atoms. In the particularly preferred polyfunctional aziridine, R is methyl.

Film Support/Photosensitive Layer

The film support may be any of the conventional polymeric films used in the manufacture of photosensitive elements, provided it either contains surface carbonyl groups or can be treated to produce carboxyl groups at the surface by, for example, flame treatment. The preferred support is polyethylene terephthalate film.

Conventional photographic grade polyethylene terephthalate film, made according to the well-known teachings of the art, is the most preferred film support. The film is cast and then stretched in both dimensions and heat relaxed to attain dimensional stability. A standard resin sub layer is applied on at least one side of the film support. Preferably, the resin sub is applied to both sides of the film support.

In the most preferred embodiment, the film support is a photographic film element comprising dimensionally stable polyethylene terephthalate film, suitably subbed on each side with a thin, anchoring substratum of a conventional resin sublayer, over which may be applied a gelatin sublayer. A preferred polyethylene terephthalate support is taught by Alles, U.S. Pat. No. 2,779,684, and a preferred resin subbing layer such as the mixed polymer subbing compositions of vinylidene chloride-itaconic acid is taught by Rawlins, U.S. Pat. No. 3,567,452, the specific disclosures of which are incorporated hereby reference.

The photosensitive layer is preferably a standard, gelatino silver halide emulsion layer which is applied on one side of the element. Conventional photographic silver halide emulsions employing any of the commonly known halides may be used. These may be of varied content and may be negative and/or positive working. Conventional additives may also be present for specific purposes, such as, for example, to enhance and stabilize the response of the emulsion. The emulsion layer is then overcoated with a conventional gelatin abrasion layer.

Other suitable photosensitive layers may also be substituted for the silver halide emulsion. Conventional photosensitive materials include: photopolymerizable compositions, diazo, vesicular image-forming materials, and the like. The films described may be used in any of the conventional imaging fields, such as, graphic arts, printing, medical and information systems, among others.

The film element of this invention is particularly useful in processes where rapid transport and machine handling of photographic film is practiced, such as, phototypesetting applications.

EXAMPLES

This invention will now be illustrated by the following examples. In these examples percentages are by weight.

EXAMPLE 1

The following solution was prepared by mixing 20,000 gm of gelatin (Kind and Knox Low Viscosity Blend #5734), added in two, substantially equal portions, to 181,000 gm of distilled water. This mixture of gelatin and water was stirred at room temperature in a conventional stirred, jacketed stainless steel reaction kettle for about 20 min and then heated to 130° F. (54° C.). When 95° F. (35° C.) was achieved, 80 gm of a 16.8% solution of synthetic silica (#72, Davison Chemical Co., Cincinnati, Ohio) dispersed in a 6.7% aqueous solution of gelatin, was added. An additional 1,000 gm of deionized water was used to rinse the silica dispersion into the vessel.

This dispersion was held at 130° F. (54° C.) for 30 min. Then cooling to 115° F. (46° C.) was started. At 128° F. (53° C.), 5,000 gm of a 14.9% aqueous solution of sodium lauryl ether sulfate (Polystep® B-27, Stephan Chemical Co., Northfield, Ill.) was added. At 121° F. (49° C.), 1,720 gm of an 18.5% aqueous solution of Dye S-1240 was added. At 119° F. (48° C.), 750 gm of a 10% aqueous solution of Acid Violet 520-T Dye and 850 gm of a 4.0% aqueous solution of light green SF Yellowish Dye were then added. Another 6,000 gm of deionized water, used to rinse out containers of these dyes, was added to the reaction vessel. At 115° F. (46° C.), 3,000 gm of a 38% aqueous solution of sodium myristyl triether sulfate wetting agent (Standapol® ES-40, Henkel, Inc., U.S.A., Hoboken, N.J.), 1,000 gm of a 8.1% aqueous solution of a fluorocarbon anionic surfactant (Fluorad® FC-127, 3M Co., St. Paul, Minn.) and 800 gm of an 8.3% aqueous sulfuric acid solution were added and the pH adjusted to 4.8 to 5.2. Then the temperature was adjusted to 120° F. (49° C.) and 2,000 gm of an aqueous urea solution (400 gm urea and about 1,600 gm deionized water, calculated to give 67 mmoles of urea/200 gm of gelatin), followed by 5,550 gm of a 3.7% aqueous formaldehyde solution, were then added.

A 0.004 inch (about 100 μm) dimensionally stable polyethylene terephthalate film having a conventional resin sublayer coated on both sides thereof was prepared. An antistatic layer prepared according to Example 1 of Miller, U.S. Pat. No. 4,859,570, was applied on one side thereof at a coating weight of about 10 mg/dm$^2$. This was followed by an auxiliary layer of the above solution coated at 43 mg gel/cm$^2$ (4.3 g gel/m$^2$). The coated film was thoroughly dried and samples taken for testing. Film made according to Cho, U.S.

Pat. No. 4,891,308, Examples 1 to 5, and film similar to that disclosed by Cho, U.S. Pat. No. 4,585,730 were used as controls.

Each sample was tested with a device which simulates the rollers of a Type 44C Du Pont Automatic Processor. In this configuration, as in other conventional automatic processors, the film passes through opposed rollers as it moves from the developer to the fixer. Since considerable strain is applied to the developer soaked film during this process, delamination may occur. In the simulation thereof, a pair of stainless steel rollers with a drive mechanism were set up with a device which can assert a measured amount of pressure thereon. This device can exert uneven pressure to simulate that caused in the processor.

The film samples were soaked in a conventional developer solution for 30 sec at 108° F. (42° C.) and passed through the rollers. A pressure of approximately 20 lbs (9.1 kg) was applied to one end of this device as the film strips were passing. Edge delamination occurred in all the control samples. No delamination occurred with the film of this invention. Additionally, both the control films and the film of this invention had equivalent antistatic properties.

CONTROL

Example 1 was repeated except that the pH was adjusted to 6.05 prior to coating. Adhesion was similar to that of the control elements of Example 1.

EXAMPLES 2–8

In these examples, various levels of urea were added to auxiliary layer solutions made as described in Example 1, coated and tested as described therein. After several weeks (up to 28) each sample was analyzed for anchorage. Results are summarized in Table 1.

TABLE 1

| Example | Amt. Urea (mmol/200 gm gel) | Anchorage Level[a] |
|---|---|---|
| Control | None | 3 |
| 2 | 50 | 0 |
| 3 | 60 | 0 |
| 4 | 70 | 0 |
| 5 | 80 | 0 |
| 6 | 90 | 0 |
| 7 | 100 | 0 |
| 8 | 110 | 0 |

[a]0 = no failure; 1 = fair; 2 = poor; 3-almost complete failure

EXAMPLE 9

Example 1 was repeated except that Rousselot standard viscosity lime bone gelatin was substituted for Kind and Knox #5374 low viscosity gelatin. The urea solution was added just prior to coating as described in Example 1. Samples of the film were dried and tested for anchorage and propensity to develop static. In all cases, the film made according to the teachings of this invention had excellent adhesion to the antistatic layer. Static protection was also excellent. The base roll of polyester film coated in this manner did not telescope during handling.

EXAMPLE 10

Example 1 was repeated except that Nitta P-3130 low viscosity lime bone gelatin was substituted for Kind and Knox #5374 low viscosity gelatin. The urea solution was added just prior to coating as described in Example 1. Samples of the film were dried and tested for anchorage and propensity to develop static. In all cases, the film made according to the teachings of this invention had excellent adhesion to the antistatic layer. Static protection was also excellent. The base roll of polyester film coated in this manner did not telescope during handling.

EXAMPLE 11

This example shows that improved anchorage is obtained with urea derivatives.

The general procedure of Example 1 was repeated except that the backing solution was prepared on a laboratory scale (25 g of gel per coating), the gel solutions were 5% gel instead of 7.5% gel, and the synthetic silica matte was omitted. Gel solutions were coated on a laboratory air knife coater and dried in loop form. Solutions were adjusted to pH=5 prior to coating. Results are given in Table 2.

TABLE 2

| Additive | Anchorage[a] Amt. of Additive (mmol/200 gm gel) 10 | 40 | 70 | 120 |
|---|---|---|---|---|
| urea | ND | ND | 0 | ND |
| N-methylurea | 3 | 0 | 0 | 0 |
| N,N-dimethylurea | 3 | 2 | 0 | 0 |
| 1,3-dimethylurea | 2[b] | ND | 0[c] | 0[d] |
| 1,3-diethylurea | 3 | 0 | 0 | 0 |
| hydroxymethylurea | 3 | 2 | 2 | 0 |
| dihydroxymethylurea | 3 | 0 | 3 | 2 |
| 2-imidazolidone | 0 | 0 | 0[e] | 0[e] |
| N,N,N',N'-tetramethylurea | 3 | 3 | 2 | 3 |
| guanine hydrochloride | 3 | 2 | 1 | 0 |
| thiourea | 2 | 0 | 0 | 0 |

ND = not determined
[a]0 = no failure; 1–4 = increasing amounts of edge failure
[b]20 mmol/200 gm gel
[c]80 mmol/200 gm gel
[d]140 mmol/200 gm gel
[e]Gel surface partly to completely hazy

EXAMPLE 12

This example shows that adhesion is improved by addition of various compounds containing a —$NH_2$ group or more than one —NH group. The effect of pH on adhesion is also shown. The general procedure of Example 11 was repeated except that solutions were prepared at both pH=5 and pH=6. The additives added at 70 mmol/200 g of gel. Results are given in Table 3.

TABLE 3

| Additive[a] | Anchorage[b] pH = 5 | pH = 6 |
|---|---|---|
| none (control) | 3 | 3 |
| urea | 0 | 1 |
| methylurea | 0 | 0 |
| 1,3-dimethylurea | 0 | 2 |
| biuret | 0 | 3 |
| guanidine hydrochloride | 0 | 3 |
| 2,5-piperazinedione | 0 | 4 |
| acetamide | 0 | 3 |
| triethyl amine | 3 | 4 |
| iso-butyl amine | 2 | 1 |
| piperidine | 3 | 3 |
| piperazine | 0 | 0 |
| ethylenediamine | 0 | 0 |
| DABCO | 3 | 4 |

[a]70 mmol additive/200 g of gel
[b]0 = no failure; 1–4 = increasing amounts of edge failure

EXAMPLE 13

This example shows the effect of various amides on anchorage. The general procedure of Example 11 was repeated with the indicated compounds. Results are given in Table 4.

TABLE 4

| Additive | Anchorage[a] Amt. of Additive (mmol/200 gm gel) 10 | 40 | 70 | 120 |
|---|---|---|---|---|
| urea | ND | ND | 0 | ND |
| acetamide | 3[b] | ND | 0[c] | 2[d] |
| N-methylacetamide | 3 | 3 | 3 | 2 |
| N,N-dimethylacetamide | 3 | 3 | 3 | 3 |
| malonamide | 3 | 3 | 3 | 3 |

ND = not determined
[a]0 = no failure; 1–4 = increasing amounts of edge failure
[b]20 mmol/200 gm gel
[c]80 mmol/200 gm gel
[d]140 mmol/200 gm gel

EXAMPLE 14

This example shows the effect of 2-imidazolidone and thiourea on adhesion. The general procedure of Example 11 was repeated except that solutions were prepared at both pH=5 and pH=6. Results are given in Tables 5 and 6.

TABLE 5

| Additive | pH | Anchorage[a] Amt. of Additive (mmol/200 gm gel) 0 | 5 | 10 | 20 | 40 |
|---|---|---|---|---|---|---|
| 2-imidazolidone | 5 | 3 | 2 | 0 | 0 | 0 |
| " | 6 | 3 | 0 | 0 | 0 | 0 |

[a]0 = no failure; 1–4 = increasing amounts of edge failure

TABLE 6

| Additive | pH | Anchorage[a] Amt. Additive (mmol/200 gm gel) 0 | 20 | 40 | 60 | 80 |
|---|---|---|---|---|---|---|
| thiourea | 5 | 3 | 2 | ND | ND | 0[b] |
| " | 6 | 4 | 4 | 0 | 0 | 0 |

ND = not determined
[a]0 = no failure; 1–4 = increasing amounts of edge failure
[b]0 at 140 mmol/200 gm gel. 0 at 240 mmol/200 gm gel. Coating was soft at 240 mmol/200 gm gel.

EXAMPLE 15

This example shows the effect of various amines on adhesion. The general procedure of Example 11 was repeated except that solutions were prepared at both pH=5 and pH=6. Results are given in Table 7.

TABLE 7

| Additive | pH | Anchorage[a] Amt. Additive (mmol/200 gm gel) 0 | 10 | 30 | 50 | 100 |
|---|---|---|---|---|---|---|
| ethylenediamine | 5 | 2 | 2 | 0 | 9 | 5 |
| " | 6 | 10 | 10 | 10 | 10 | 10 |
| piperazine | 5 | 3 | 0 | 10 | 10 | 10 |
| " | 6 | 4 | 7 | 9 | 10 | 10 |
| diethylenetriamine | 5 | 4 | 2 | 10 | 10 | 10 |
| " | 6 | 4 | 7 | 10 | 10 | 10 |
| triethylenetetraamine | 5 | 3 | 2 | 10 | 10 | 10 |

TABLE 7-continued

| Additive | pH | Anchorage[a] Amt. Additive (mmol/200 gm gel) 0 | 10 | 30 | 50 | 100 |
|---|---|---|---|---|---|---|
| " | 6 | 2 | 2 | 6 | 10 | 10 |

ND = not determined
[a]0 = no failure; 1–4 = increasing amounts of edge failure; 5 = total edge failure; 6–9 = increasing failure in from edge; 10 = complete delamination.

EXAMPLE 16

The general procedure of Example 11 was repeated with ethylenebisurea except that ethylenebisurea was investigated at both pH=5 and pH=6.

TABLE 8

| Additive | pH | Anchorage[a] Amt. Additive (mmol/200 gm gel) 0 | 20 | 50 | 70 | 120 |
|---|---|---|---|---|---|---|
| ethylenebisurea | 5 | 2 | 2 | 0 | 0 | 0 |
| " | 6 | 4 | 3 | 3 | 2 | 0 |

[a]0 = no failure; 1–4 = increasing amounts of edge failure

EXAMPLE 17

The following solution was prepared by mixing 200 gm of gelatin (PB Gelatins UK Ltd, Type 5003), 1881 gm of distilled water, and 0.8 gm of a 17% dispersion of synthetic silica (Syloid® 378, Grace GmbH, Worms, Germany) in gelatin. This mixture was stirred at room temperature in a conventional stainless steel reaction kettle for about 40 min and then heated to 130° F. (54° C.).

The dispersion was held at 130° F. (54° C.) for 25 min. Then cooling to 100° F. (38° C.) was started. At 100° F. (38° C.), 140 gm of 1:1 ethanol/water, 29.9 gm of a 10% aqueous solution of Acid Violet 520, 111.7 gm of a 10% aqueous solution of Oxonol Yellow (S-1240 Gaspar Yellow), 105 gm of a 14.9% aqueous solution of sodium lauryl ether sulfate (Triton® X-200, Rohm and Haas, Philadelphia, Pa.), 24 gm of a 5% aqueous solution of fluorocarbon anionic surfactant (Fluorad® FC-127, 3M Co., St. Paul, Minn.), and 2 gm of Lensodel HB 7 (Shell Chemie GmbH, Eschborn, Germany) were added. Aqueous sulfuric acid or aqueous sodium hydroxide was added to adjust the pH to the desired value. Then 95 gm of Latex CP 16 (Du Pont de Nemours Luxembourg SA, Luxembourg) were added. A 20% aqueous urea solution (21 gm), calculated to produce 70 mmol of urea/200 gm of gelatin was added, followed by 8.87 gm of 4.7% aqueous formaldehyde.

A 0.004 inch (about 100 μm) dimensionally stable polyethylene terephthalate film having a conventional resin sublayer coated on both sides thereof was prepared. An antistatic layer prepared according to Example 1 of Miller, U.S. Pat. No. 4,859,570, was applied on one side thereof at a coating weight of about 10 mg/dm². This was followed by a layer of the above solution coated at 50 mg gel/dm². The gelatin solutions were coated on a laboratory bar coater and dried in a spiral drier. Anchorage was measured as described in Example 1. Results are given in Table 9.

TABLE 9

| pH of Backing | Anchorage[a] |
|---|---|
| Control[b] | 3 |
| 5.0 | 0 |

TABLE 9-continued

| pH of Backing | Anchorage[a] |
|---|---|
| 5.5 | 0 |
| 6.0 | 0 |
| 6.5 | 0 |
| 7.0 | 0 |

[a]0 = no failure; 1–4 = increasing amounts of edge failure.
[b]pH 5, no urea.

What is claimed is:

1. A photographic element comprising:

(A) a polymeric film support having carboxyl groups attached to the surface thereof;

(B) a photosensitive layer coated on one side of the support;

(C) a permanent antistatic layer coated directly on the surface of the support opposite the photosensitive layer, said antistatic layer consisting essentially of the reaction product of:

(1) a water-soluble, electrically conductive polymer having functionally attached carboxyl groups integral to the polymer, and (2) a polyfunctional substituted aziridine wherein at least one hydrogen atom on a carbon atom of the aziridine ring is substituted with an alkyl substituent wherein alkyl is of 1 to 6 carbon atoms, wherein the aziridine interlinks the water-soluble, electrically conductive polymer having functionally attached carboxyl groups integral to the polymer and the carboxyl groups on the surface of the support to form an antistatic layer; and (D) an auxiliary layer coated over said antistatic layer, said auxiliary layer consisting essentially of an aqueous dispersion of gelatin, a gelatin cross-linking agent, and an adhesion promoting amount of an adhesion agent selected from the group consisting of 1) a compound containing at least one —$NH_2$ group, 2) a compound containing at least two —NH groups, and 3) mixtures thereof, wherein said adhesion agent is sufficiently soluble in water that said adhesion promoting amount of adhesion agent may be dissolved in the dispersion used to coat said auxiliary layer, with the proviso that said adhesion agent is not malonamide.

2. An element according to claim 1 wherein said adhesion agent has a boiling point greater than 65° C.

3. An element of claim 1 wherein said adhesion agent is selected from the group consisting of amides containing at least one —$NH_2$ group, amides containing at least two —NH groups, urea, substituted ureas containing at least one —$NH_2$ group, substituted ureas containing at least two —NH groups, guanidine hydrochloride, and thiourea.

4. An element according to claim 3 wherein said auxiliary layer has a coating weight of about 20 mg/dm$^2$ to about 100 mg/dm$^2$.

5. An element according to claim 1 wherein said adhesion agent is urea.

6. An element according to claim 1 wherein said adhesion agent is 2-imidazolidone.

7. An element according to claim 1 wherein said adhesion agent is thiourea.

8. An element according to claim 1 wherein said photosensitive layer comprises a gelatino silver halide emulsion layer coated on the side of said support opposite the antistatic and auxiliary layers.

9. An element according to claim 1 wherein antihalation dyes are present in said auxiliary layer.

10. An element according to claim 3 wherein said adhesion agent is present in the amount of 10–150 millimoles per 200 gm of gelatin present.

11. An element according to claim 3 wherein said photosensitive layer comprises a gelatino silver halide emulsion layer coated on the side of said support opposite the antistatic and auxiliary layers.

12. An element according to claim 11 wherein said antistatic layer is applied at a coating weight of about 4 mg/dm$^2$ to about 15 mg/dm$^2$.

13. An element according to claim 11 wherein in the antistatic layer, on a weight basis, the proportions of (1) to (2) range from 100:4 to 100:30.

14. An element according to claim 11 wherein a hydrogen atom on an aziridinyl carbon atom is substituted with a methyl group.

15. An element according to claim 11 wherein said conductive polymer (1) is copolymer of the sodium salt of styrene sulfonic acid and the disodium salt of maleic acid.

16. An element according to claim 15 wherein said adhesion agent is selected from the group consisting of urea, substituted ureas containing at least one —$NH_2$ group, substituted ureas containing at least two —NH groups, guanidine hydrochloride, and thiourea.

17. An element according to claim 16 wherein said adhesion agent is urea.

18. An element according to claim 16 wherein said adhesion agent is 2-imidazolidone.

19. An element according to claim 16 wherein said adhesion agent is thiourea.

20. An element according to claim 16 wherein said adhesion agent is present in the amount of 10–150 millimoles per 200 gm of gelatin present.

21. An element according to claim 16 wherein said auxiliary layer has a coating weight of about 35 mg/dm$^2$ to about 65 mg/dm$^2$.

* * * * *